US005642816A

United States Patent [19]

Kelly et al.

[11] Patent Number: 5,642,816

[45] Date of Patent: Jul. 1, 1997

[54] PIPETTE TIP RACK REFILL PLATE HOLD DOWN APPARATUS

[75] Inventors: Christopher Kelly, Larkspur; Kenneth Rainin, Piedmont, both of Calif.

[73] Assignee: Rainin Instrument Co., Inc., Emeryville, Calif.

[21] Appl. No.: 548,233

[22] Filed: Oct. 25, 1995

[51] Int. Cl.[6] ..... A47F 7/00

[52] U.S. Cl. ..... 211/60.1; 211/74; 422/100; 422/104; 206/486; 206/562

[58] Field of Search ..... 211/60.1, 74; 422/100, 422/104, 922; 206/486, 562, 443, 446

[56] References Cited

U.S. PATENT DOCUMENTS

| | | | |
|---|---|---|---|
| 3,937,322 | 2/1976 | Cohen | 206/486 X |
| 4,779,467 | 10/1988 | Rainin et al. | 422/100 X |
| 5,324,482 | 6/1994 | Scaramella et al. | 422/104 X |
| 5,366,088 | 11/1994 | Hill et al. | 206/562 X |
| 5,392,914 | 2/1995 | Lemieux et al. | 206/486 X |
| 5,441,702 | 8/1995 | Lemieux et al. | 422/100 |
| 5,487,997 | 1/1996 | Stolp | 422/104 X |

*Primary Examiner*—Robert W. Gibson, Jr.
*Attorney, Agent, or Firm*—Robert R. Meads

[57] ABSTRACT

A reusable pipette tip rack for successively receiving and dispensing arrays of pipette tips and including a manually releasable latch mechanism for securing a support plate carrying an array of pipette tips flat on the top of a support tray of the pipette tip rack with the array of tips seated in an array of openings in the top of the support tray. The latch mechanism comprises a latch including a laterally extending locking surface on one of the support plate or the support tray and a manually releasable locking member extending from the other of the support plate or the support tray. Preferably, the latch mechanism comprises a combination of two such latches each including a locking member and locking surface located at opposite edges of the support tray of the pipette tip rack.

17 Claims, 5 Drawing Sheets

PIPETTE TIP RACK REFILL PLATE HOLD DOWN APPARATUS

FIELD OF INVENTION

The present invention relates to the refilling of reusable pipette tip racks and, more particularly, to apparatus for releasably securing refill plates containing replacement pipette tips to the support trays of reusable pipette tip racks.

BACKGROUND OF INVENTION

It is the function of pipette tip racks to organize disposable pipette tips in a manner for convenient tip placement on a pipette. Generally, such racks comprise a rigid base with vertical sides joined at contiguous edges and horizontally supporting a rigid pipette tip organizing tray having an array of pipette tip receiving holes extending through a top surface of the tray. Alternatively, such tip racks comprise a rigid tray which includes support sides or legs and a flat top surface containing an array of holes for receiving and supporting an array of pipette tips. In either case, the pipette tips are organized and held vertically by the array of holes for ease of access by a pipette. In this regard, a technician simply places a hand holdable pipette over the rack and lowers a distal end of the pipette into a proximal or upper end of a vertically oriented pipette tip and presses down to a affix the tip to the pipette. A similar operation is followed by a technician when connecting a plurality of tips to a multiple tip pipette. U.S. Pat. No. 4,676,377 describes a conventional pipette tip rack of the type just described and U.S. Pat. No. 4,779,467, describes a multiple tip pipette.

Once all tips are dispensed from the pipette tip rack, the rack may be discarded or reloaded with a new supply of pipette tips. U.S. Pat. Nos. 5,324,482 and 5,392,914, describe pipette tip packaging systems and refill packs for pipette tip racks for loading new supplies of pipette tips into reusable tip racks. With the packaging described in U.S. Pat. No. 5,324,482, a technician grasps and positions an alignment plate over a stack of trays containing replacement pipette tips. The technician presses downward on the alignment plate to engage a latching mechanism securing the alignment plate to an uppermost one of the pipette tip containing trays. The technician then moves the tip tray over an empty pipette tip rack, lowers the tip tray onto a top of the empty tip rack and depresses a release button disengaging the latching mechanism to allow the tip tray and the replacement pipette tips to drop into place in the tip rack. With the refill pack described in U.S. Pat. No. 5,392,914, the technician places a refill pack over the top of the reusable tip rack and, in one embodiment, simply presses down on the top of the pack to release a refill plate containing an array of replacement pipette tips into the empty tip rack.

In both the pipette tip packaging system and the refill pack described in the above-identified patents, a refill plate or tip tray carrying an array of replacement pipette tips lays on a top surface of a support tray of the pipette tip rack. When the technician desires to attach a pipette tip to a pipette, he follows the previously described method of placing a hand holdable pipette over the rack and lowering a distal end thereof into an upper end of a vertically oriented pipette tip, and pressing down to affix the tip to the pipette. As the technician lifts the pipette from the tip rack, the refill plate or tip tray tends to lift with the pipette tip from the top surface of the support tray of the tip rack. The frequency of such occurrences depends upon the downward force exerted by the technician in attaching the pipette tip to the hand holdable pipette and further depends upon whether hand holdable pipette is a single or multiple tip pipette, the occurrences being more common with multiple tip pipettes. To preclude such undesired lifting of the refill plate or tip tray from the support tray during the loading of pipette tips onto hand holdable pipettes, the commercial products corresponding to those illustrated and described in U.S. Pat. Nos. 5,324,482 and 5,392,914 have heretofore included hold down devices comprising conventional "arrow" clips positioned in diagonally opposite ones of the holes in the refill plate or tip tray containing the replacement pipette tips. Such arrow clips include an enlarged head for engaging the upper surface of the refill plate or tip tray. Shank portions of the arrow clips pass through the holes in the refill plate tray while enlarged lower ends of the arrow clip fit snugly into and extend slightly beyond corresponding holes in the support tray of the tip rack. Such arrow clips firmly affix and hold down the refill plates and tip trays on the top surface of the support tray of the tip rack.

Unfortunately, such arrow clips are inserted into holes which otherwise would contain replacement pipette tips. This of course limits the number of replacement pipette tips which may be contained in the packaging system and refill pack of the above described patents. Further, the use of the arrow clips requires the technician to manually secure the refill plate or tip tray to the tip rack. Of course, when it is desired to again refill the reusable tip rack with pipette tips, the technician must manually remove the arrow clips from the refill plate or tip tray to allow for a subsequent reloading of the tip rack in the manner previously described. Such manual attachment and removal operations are not only bothersome to the technician, but they may also lead to undesired contamination of the pipette tips by contact with the technician hands. Further, the arrow clips constitute additional components and material which must be disposed of after use which counteracts a major purpose of the packaging system and refill pack for pipette tip racks, namely, the minimizing of disposable waste.

Accordingly, there is a continuing need for a refill plate or tip tray hold down apparatus which (1) automatically secures the refill plate or tip tray to the top surface of the support tray of a reusable tip rack, (2) is readily disengaged when it is desired to remove the refill plate or tip tray from the tip rack, (3) does not occupy holes normally containing pipette tips and (4) does not add to disposable waste associated with the refill pack system. The present invention satisfies such needs.

SUMMARY OF INVENTION

The present invention satisfies the foregoing needs by providing a manually releasable latch mechanism preferably comprising latches at opposing sides of a support tray of a reusable pipette tip rack. The latches are designed to engage opposing edges of a support plate for an array of replacement pipette tips as the support plate is lowered onto the top surface of the support tray. Preferably, the latches automatically accommodate such downward movement of the support plate and automatically engage with locking members engaging locking surfaces to hold down the support plate flat on the top of the support tray. Then, when it is desired to release the support plate from the support tray, the latches disengage by a simple manual release of the locking members from the locking surfaces.

Basically, each latch comprises a laterally extending locking surface on one of the support plate or the support tray and a manually releasable locking member extending from the other of the support plate or support tray for releaseably engaging the locking surface to releasably secure the support plate flat on the top of the support tray.

Thus, without occupying holes for receiving replacement pipette tips, and without requiring independent attachment operation by a technician, the present invention provides a simple and inexpensive hold down apparatus for releasably securing refill plates and tip trays to reusable pipette tip racks without creating additional waste which must be disposed of after each reloading of a reusable tip rack.

DETAILED DESCRIPTION OF INVENTION

Figure 1:
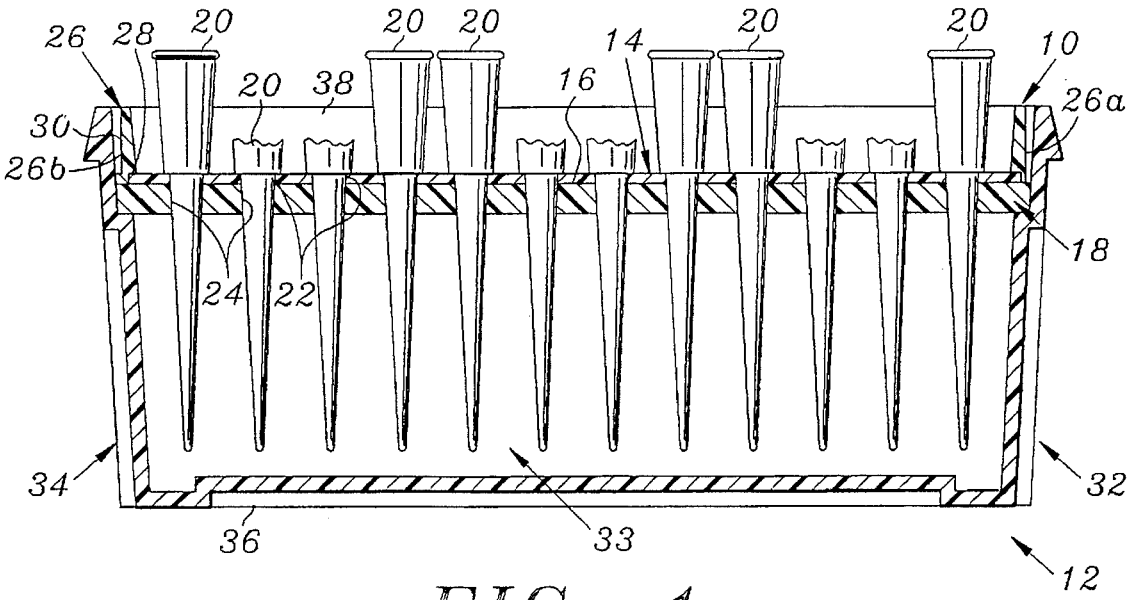
FIG. 1 is a sectional side view of a reusable tip rack including a support tray supporting a support plate carrying an array of pipette tips and illustrating a preferred version of the hold apparatus of the present invention comprising a latch mechanism having latches at opposite edges of the support tray for releasably securing the support plate flat on top of the support tray.

Generally speaking, the hold down apparatus of the present invention comprises a manually releasable latch mechanism 10 useful in a variety of reusable pipette tip racks 12. It is the function of the latch mechanism to releaseably secure a support plate 14 flat on a top surface 16 of a support tray 18 included in the tip rack 10. The support plate 14 carries an array of pipette tips 20 extending through an array of holes 22 in the support plate 14. When positioned on top of the support 18, the support plate 14 positions the array of pipette tips 20 such that the distal ends of the pipette tips extend downwardly through a matching array of holes 24 in the top surface 16 of the support tray 18.

The drawings illustrate various embodiments of the latch mechanism 10. Common to the various embodiments of the latch mechanism 10 is a latch 26 including a laterally extending locking surface 28 and a manually releasable locking member 30. Preferably, the latching mechanism 10 includes two such latches **26*a* and 26*b* located at opposing sides of the support tray 18 to engage opposing edge surfaces of the support plate 14 to hold the support plate flat on the top surface 16 of the support tray 18**.

More particularly, the laterally extending locking surface 28 of each of the latches **26*a* and 26*b* is located on one of the support plate 14 or the support tray 18. The manually releasable locking member of each such latch 26*a* and 26*b* extends from the other of the support plate 14 or the support tray 18** to releaseably engage its associated locking surface to releaseably secure the support plate flat on the top of the support tray.

Figure 2:
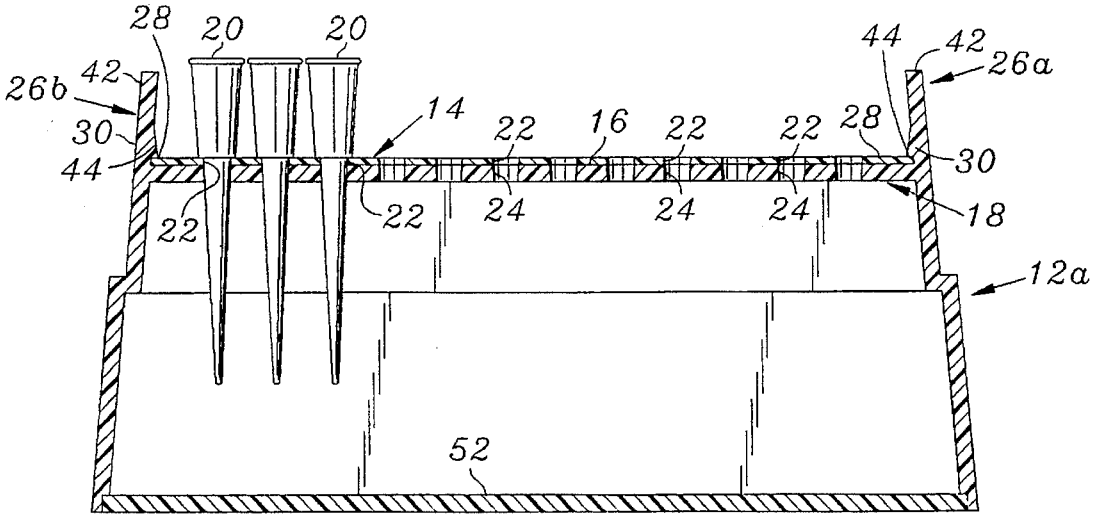
FIG. 2 is a sectional side view of a different form of reusable tip rack comprising a support tray with vertically extending side members and a closed base, a support plate carrying an array of pipette tips being held flat on top of a top surface of the support tray by the preferred version of the hold down apparatus of the present invention shown in FIG. 1 and comprising a latch mechanism including latches at opposite sides of the support tray for releaseably engaging and holding the support plate flat on the top surface of the support tray.
Figure 3:
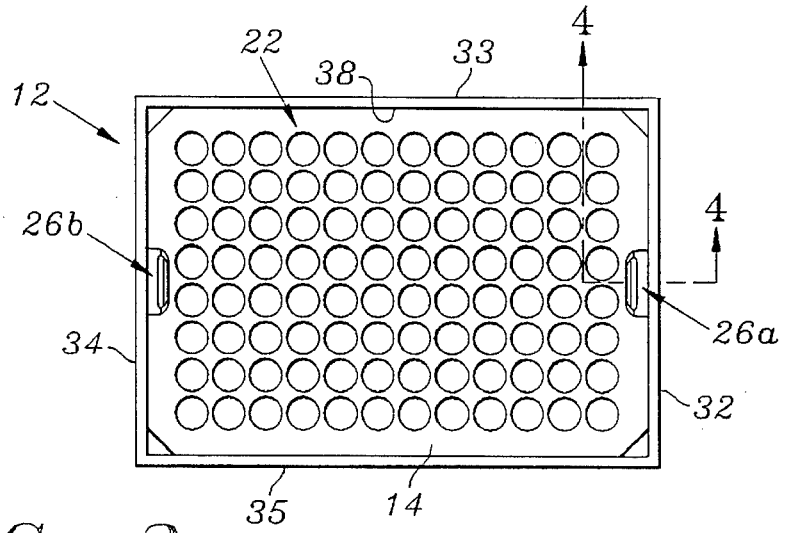
FIG. 3 is a top view of the reusable tip rack of FIG. 1 showing the preferred version of the hold down apparatus of the present invention at opposite marginal edges thereof extending over a top surface of the support tray.
Figure 4:
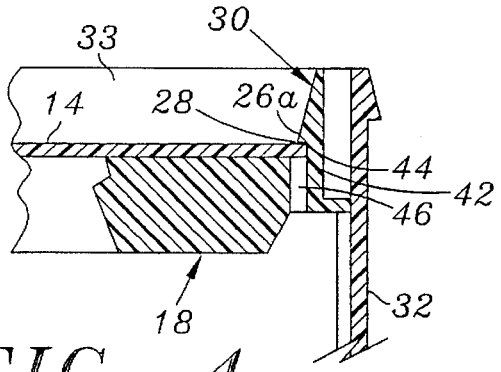
FIG. 4 is an enlarged fragmentary sectional side view along line 4—4 in FIG. 3 illustrating in cross section one of the latches included in the hold down apparatus for securing the support plate to the top surface of the support tray in the reusable tip rack of FIG. 3.

More particularly, a preferred form of the hold down apparatus of the present invention is adapted for use with the reusable pipette tip racks shown, for example, in FIGS. 1–4. The tip rack of FIGS. 1, 3 and 4 is designated by the numeral 12 while the tip rack illustrated in FIG. 2 is designated by the numeral 12*a*.

As shown in FIGS. 1 and 3, the reusable pipette tip rack 12 includes vertically extending contiguous side members 32, 33, 34, and 35, secured to define a rack in the form of a housing having a closed bottom 36, closed sides and an open top 38 tightly receiving the support tray 18 for the array of disposable pipette tips 20. In this regard, the support tray 18 is tightly supported on a shoulder in the side members 32, 33, 34, and 35 with the array of holes 24 receiving the lower end portions of the array of pipette tips 20 carried by the support plate 14.

To hold the support plate 14 flat on the top surface 16 of the support tray 18, the preferred embodiment of the latch mechanism 10 of the present invention comprises the pair of finger releasable hold down latches 26*a* and 26*b* located at opposing sides of the support tray. By way of example only, the latches 26*a* and 26*b* shown in FIGS. 1–4 are located at the right and left sides of the rack 12 to engage and hold down right and left edges of the support plate 14 to maintain the plate flat on the top surface 16 of the support tray 18 during the dispensing of pipette tips 20 from the tip rack 12, as previously described.

As shown most clearly in FIG. 4 for the latch 26*a*, the preferred form of the latches 26*a* and 26*b* each includes a locking surface 28 on a top of the support plate 14 and a locking member 30 extending from the support tray 18 to engage the locking surface and releaseably secure the support plate flat on the top surface of the support tray 18. More particularly, the locking member 30 preferably comprises a locking arm 42 extending vertically from the support tray 18 above the locking surface 28 and a locking shoulder 44 extending laterally inwardly toward the support plate 18 to releasably engage the locking surface. Preferably, as shown most clearly in FIGS. 3 and 4, the locking arm 42 is formed of a plastic material and is located in a recess formed in a side of the support tray 18. The arm is shaped to extend inwardly from an edge of the support tray and then upwardly above the top surface 16 of the support tray 18 with the locking shoulder 44 extending inwardly over a through-hole 46 in the edge portion of the support tray. The locking shoulder 44 is designed to engage the edge of the flat top surface 16 of the support plate 14 defining the locking surface 28.

The latch 26*b* of the latch mechanism 10 is a mirror image of the latch 26*a* shown in detail in FIG. 4. In this regard, the latch 26*b* is adapted to releaseably engage an edge of a top surface of a left side of the support plate 14 defining the locking surface 28 for the latch 26*b* to secure the left side of the support plate flat the top surface 16 of the support tray 18.

In the foregoing manner, the latches 26*a* and 26*b* combine to maintain the support plate 14 flat on the top 16 of the support tray 18 during the dispensing of pipette tips from the tip rack 12 in the manner previously described. The latches 26*a* and 26*b* will retain the support plate 14 on the support tray 18 until such time as all pipette tips have been dispensed from the rack 12. At that time, the support plate 14 may be released from the support tray 18 and removed from the rack. This may be accomplished by the exertion of outwardly directed finger forces on the exposed upper portions of the locking arms 42 of the latches 26*a* and 26*b* to deflect the locking arms outwardly releasing the locking shoulders 44 from the locking surfaces 28. In such a release position, the support plate 14 may be removed from the rack 12 simply by inverting the rack and allowing the support plate to drop from the open top 38. Thus, the preferred embodiment of the latch mechanism 10 of the present invention affectively locks the support plate 14 carrying an array of pipette tips 20 flat on top of the support tray 18 during use of the tip rack 12 and allows for simple manual release of the latches comprising the latch mechanism to permit the empty pipette tip support plate 18 to be removed from the tip rack as desired.

It is a further feature of the preferred embodiment of the latch mechanism 10 that the latch mechanism automatically accommodates placement of the support plate 14 on the top surface 16 of the support tray 18 and automatically locks the support plate in place. This is most clearly illustrated with reference to the embodiment of the latch 26*b* depicted in FIGS. 5, 6 and 7*a*. As represented by the latch 26*b*, the locking arm 42 of each latch preferably carries an upwardly and outwardly sloping cam surface 48 above its associated locking shoulder 44. As represented most clearly in FIG. 5, as the support plate 14 is lowered toward the support tray 18, lower edges of the support plate engage the cam surfaces 48 and as illustrated in FIG. 6 for the latch 26*b*, result in a deflection of the locking arms outwardly to accommodate downward movement of the support plate 14 onto the top surface 16 of the support tray 18. At that position, and as illustrated FIG. 7A, the locking arms automatically snap back and the locking shoulders 44 engage the top of the locking surfaces 28 to secure the support plate in place on the top 16 of the support tray 18. Thus, the latch mechanism 10 of the present invention features an automatic locking of the support plate 14 to the support tray 18.

Figure 5:
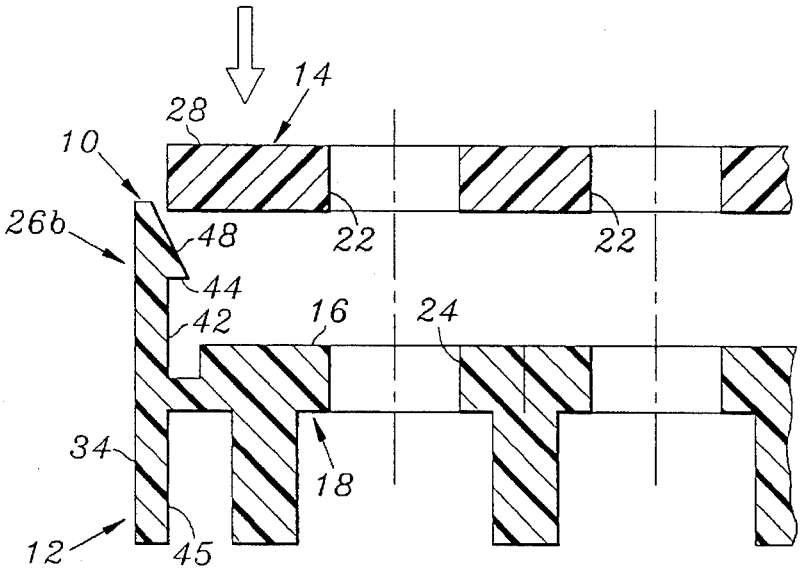
FIG. 5 is an enlarged fragmentary sectional side view of the latch included in the hold down mechanism of the present invention illustrated in FIG. 3 which is opposite that illustrated in FIG. 4 and showing the support plate being lowered toward the top surface of the support try.
Figure 6:
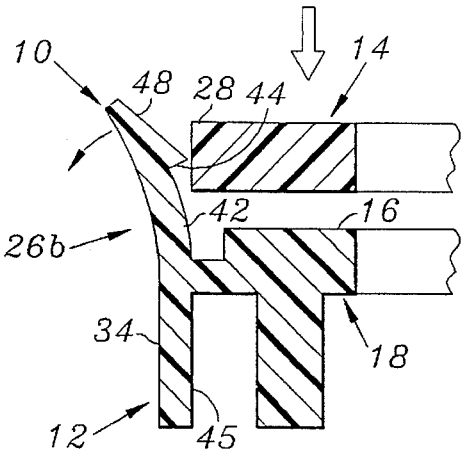
FIG. 6 is an enlarged fragmentary sectional side view illustrating the support plate as it engages a cam surface on the latch of FIG. 5 with downward movement of the support plate deflecting or bending a locking member of the latch outwardly allowing the support plate to pass the latch.
Figure 7A:
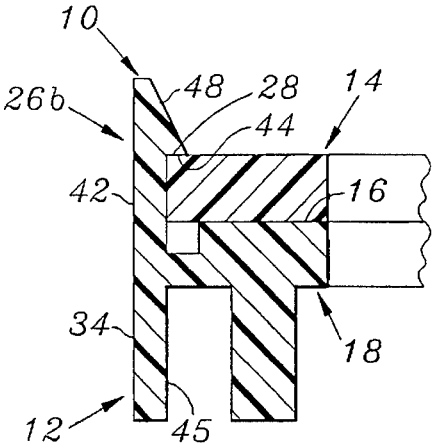
FIG. 7A is an enlarged fragmentary sectional side view similar to FIG. 6 showing the support plate on the top surface of the support tray with the latch engaged to hold the support plate down on top of the support tray.
Figure 7B:
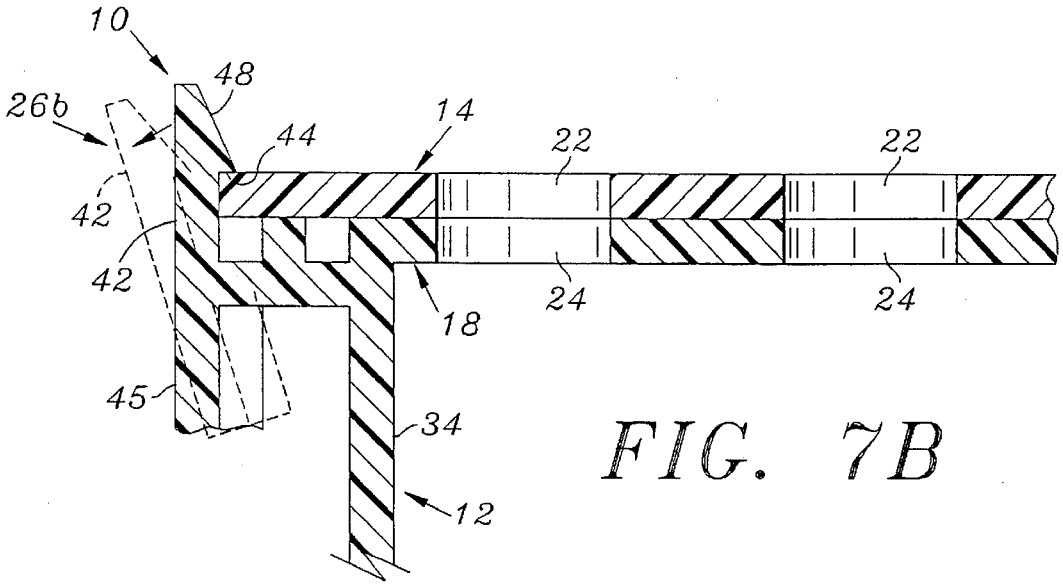
FIG. 7B is an enlarged fragmentary sectional side view similar to FIG. 7A showing in phantom outline a release of the latch by an inward force exerted on a leg depending downwardly from the locking member of the latch to allow the support plate to be removed from the top of the support tray.

Further, while FIGS. 5, 6 and 7*a* diagrammatically illustrate the automatic locking operation of the latch mechanism 10 of the present invention, the structure of the support tray 18 shown in FIGS. 5–7A differs somewhat from that depicted in FIGS. 1, 3 and 4. In FIGS. 5–7A, the support tray 18 comprises the rack 12 including side members such as 34 which extend to a closed bottom for the rack. Further, as depicted in the embodiment of the latch 26*b* illustrated in FIGS. 5–7A, the locking arm 42 includes a downward extension or leg 45 opposite the locking shoulder 44. As illustrated in FIG. 7B, the leg 45 functions as an inward force receiving member for rotating the locking arm 42, as shown in the phantom outline, to affect a release of the latch 26*b* and the support plate 14 from the support tray 18. In this regard, the leg 45 on the latch 26*b* (and the mirror image latch 26*a*) provides an alternative to the upward extension of the locking arm for receiving a finger force to affect a release of the latch(es), As previously indicated, the latch mechanism 10 of the present invention is adapted for use with pipette tip racks of various structure. FIG. 2 illustrates a different type of structure wherein the rack 12*a* is formed from the support tray 18 and a flat bottom member 52. The latches 26*a* and 26*b* of the latch mechanism 10 extend upwardly from the right and left side of the support tray 18 with the locking arms 42 adapted for finger contact by the user and with the locking shoulders 44 extending inwardly over the top of the right and left edges of the support plate 14 defining the locking surface 28 for the latch mechanism 10.

The mirror image latches 26*a* and 26*b* comprising the latch mechanism 10 of FIG. 2 function in the manner previously described and illustrated in FIGS. 5–7A with respect to the automatic locking operation to secure the support plate 14 flat on the top 16 of the support tray 18. The latch mechanism 10 also functions in the manner previously described to release the support plate 14 from the support tray 18. In that regard, upon the exertion of outward finger pressure on the upper portions of the locking arms 42, the locking arms will deflect outwardly to affect a release of the latches **26*a* and 26*b* permitting the support plate to be released from the support tray 18 simply by inverting the tip rack 12*a***.

Figure 8:
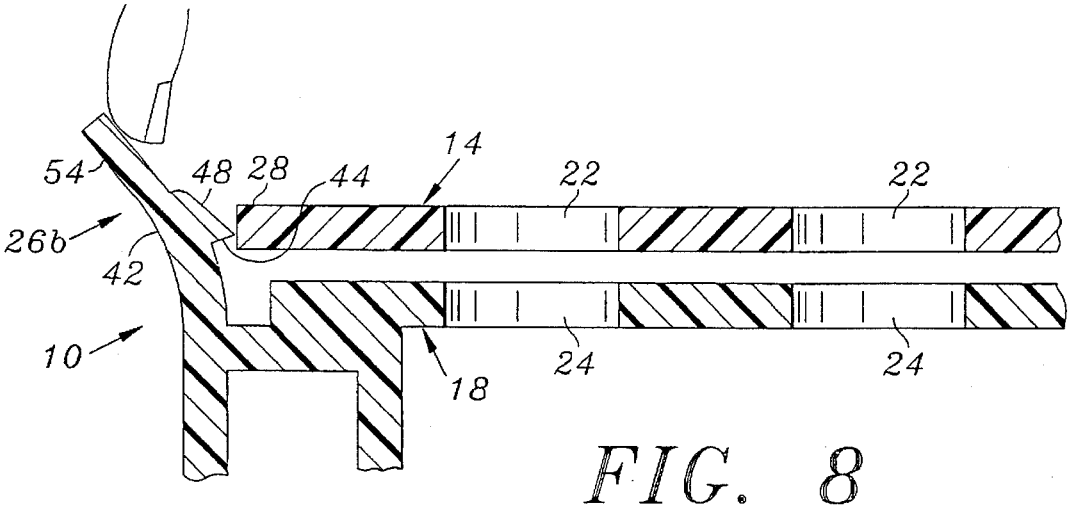
FIG. 8 is an enlarged fragmentary sectional side view showing an alternative embodiment of the latch illustrated in FIGS. 7A and 7B having an extension for finger engagement to bend or deflect the locking member of the latch outwardly when it is desired to release the latch and allow the support plate to be removed from the top of the support tray.

Further alternative structures for the latches comprising the latch mechanism 10 of the present invention are depicted in FIGS. 8–14, each of which depicts the latch **26*b* of the pair of mirror image latches comprising the latch mechanism. In FIG. 8, the latch 26*b* is illustrated as comprising an extension 54 from and above the cam surface 48 for receiving a finger force from a user to deflect the locking arm 42 outwardly to aide in a release of the latch 26*b* and a separation of the support plate 14 from the support tray 18**.

Figure 9:
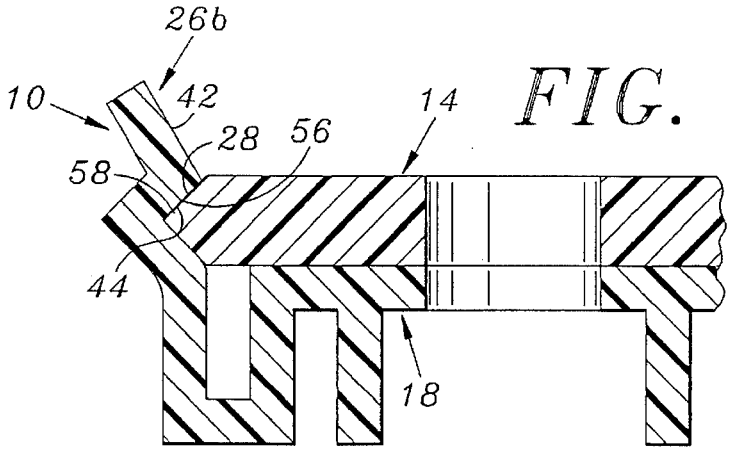
FIG. 9 is an enlarged fragmentary sectional side view showing an alternative embodiment of the latch comprising a recess in a locking member of the latch for receiving a laterally projecting edge of the support plate to releaseably secure the support plate on the top of the support tray.

In the embodiment illustrated in FIG. 9, the locking arm comprises an inwardly "V" shaped recess 56 for receiving a similarly "V" shaped marginal edge 58 of the support plate 14. In the illustrated embodiment, the locking shoulder 44 comprises the downwardly facing surface of the "V" shaped recess 56 and the locking surface 28 comprises the upwardly facing surface of the "V" shaped edge 58 of the support plate.

Figure 10:
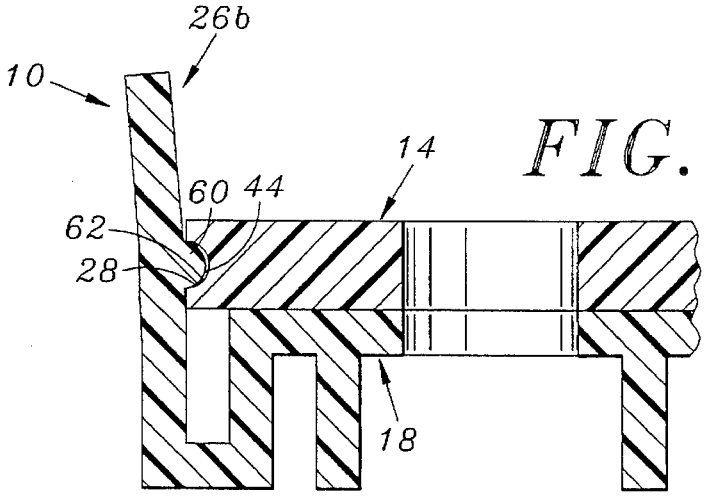
FIG. 10 is an enlarged fragmentary sectional side view of an alternative embodiment of the latch having a laterally extending projection from a locking member of the latch for engaging a recess in a marginal edge of the support plate to releaseably hold the support plate flat on top of the support tray.

The alternative embodiment shown in FIG. 10 illustrates the latch mechanism **26*b* as comprising a semi-circular laterally extending projection 60 for nesting and mating in a similar semi-circular recess 62 in an edge of the support plate 14. In the illustrated embodiment, the downwardly facing curved surface of the projection defines the locking shoulder 44 while the upwardly curved portion of the recess in the support plate defines the locking surface 28 of the latch 26*b***.

In each of the foregoing embodiments, the latch mechanisms have included mirror image latches **26*a* and 26*b* each having a locking member 30 extending from the support tray 18 and a locking surface 28 on the support plate 14 for releaseably holding the support plate flat on the top 16 of the support tray. In the embodiments illustrated in FIGS. 11–14, the mirror image latches 26*a* and 26*b* forming the latch mechanism 10 each comprise a locking surface 28 on the support tray 18 and a locking member 30 extending from the support plate 14. For example, for the latch 26*b* illustrated in FIG. 11, the locking member 30 comprises the locking arm 42 extending downwardly from a left edge of the support plate 14 through a mating hole 64 in the top 16 of the support tray 18. The locking arm 42 carries an outwardly extending locking shoulder 44 for engaging a downwardly facing locking surface 28 on the support plate 18. While not specifically shown, a similar but mirror image structure is included in the latch 26*a***.

Figure 11:
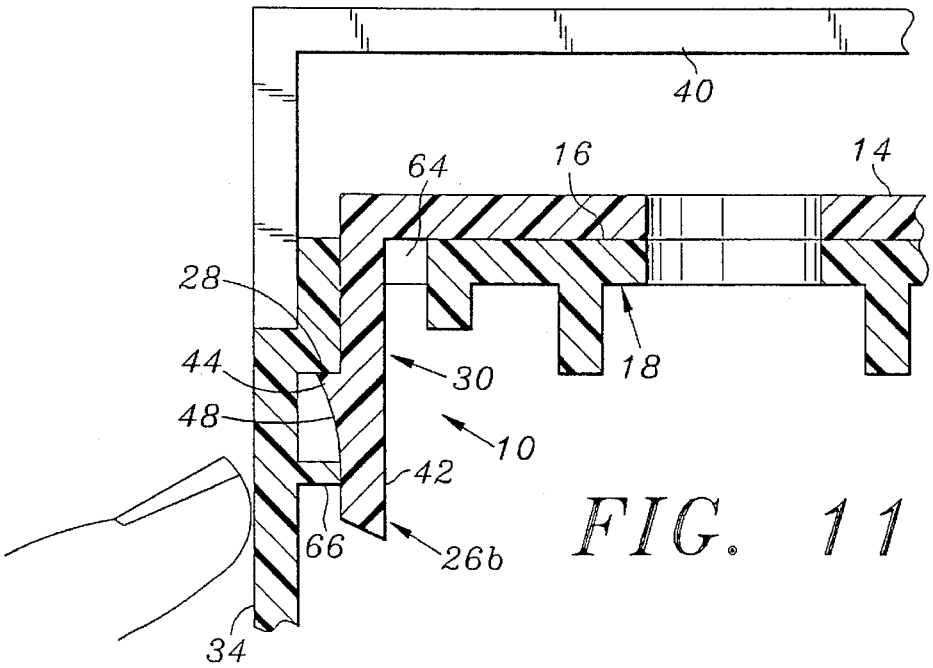
FIG. 11 is an enlarged fragmentary sectional side view of an alternative embodiment of the latch comprising a locking member extending from the support plate through a hole in a top of the support tray to engage a locking surface or shoulder on an underside of the support tray, the latch being releasable by inward finger pressure on a side of the support tray pressing an extension against the locking member to move the locking member from the locking surface to release the support plate from the support tray.

To use the latch mechanism 10 of FIG. 11, the user positions the support plate 14 over the top of the support tray 18 with the locking arms 42 extending downward through the mating holes 64 in the top of the support tray. As illustrated by the latch **26*b*, the locking arm 42 of each of the mirror image latches includes a cam surface 48 below its locking shoulder 44 which engages the edge of the associated mating hole 64 to cause the locking arm to deflect inwardly in passing through the mating holes. Once the locking arms 42 clear the mating holes 64, the locking arms automatically snap outwardly to cause the locking shoulders 44 to engage the locking surfaces 28 to secure the support plate 14 in place as shown FIG. 11 relative to the latch 26*b*. Then when it is desired to release the latches, such as latch 26*b*, the user simply presses inward on a side 34 of the pipette tip rack 12 as shown. This causes an inward projection 66 from a side of the tip rack to engage and deflect the adjacent locking arm inwardly to affect a release of the latch 26*b*. Similar and simultaneous release of the latch 26*a* will then allow the support plate 14 to release from the support tray 18 and to be dispensed from the pipette tip rack 12** by a simple inversion of the rack.

Figure 12:
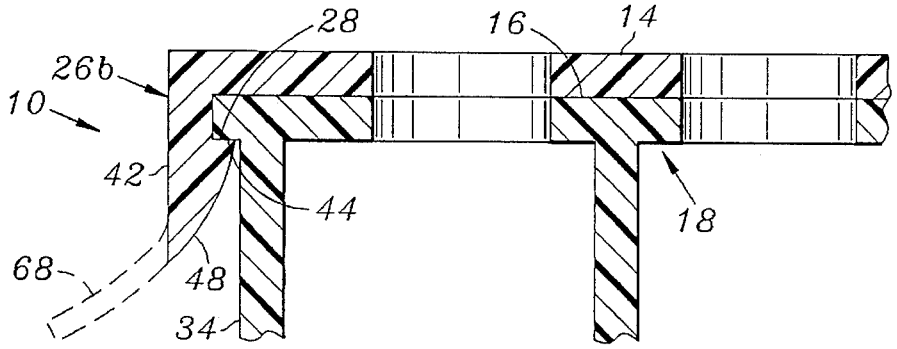
FIG. 12 is an enlarged fragmentary sectional side view of an alternative embodiment of the latch comprising a locking member extending downwardly from an edge of the support plate to engage a downwardly facing locking surface at a marginal edge of the support tray.
Figure 13:
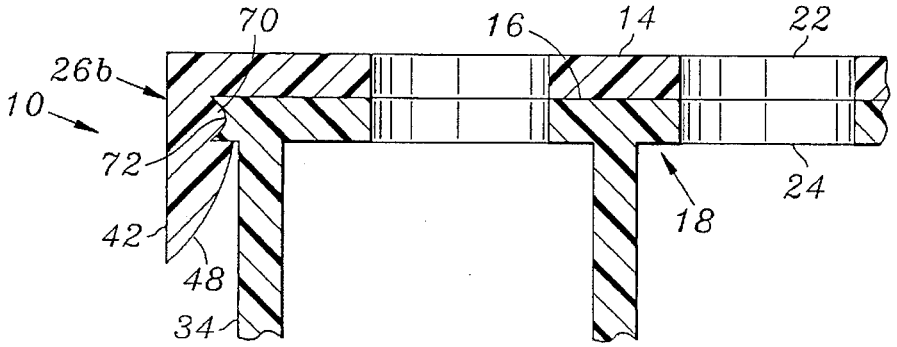
FIG. 13 is an enlarged fragmentary sectional side view similar to FIG. 12 wherein the locking member carries an inward projection for engaging a recess in a marginal edge of the support tray to releaseably secure the support plate flat on top of the support tray.

FIGS. 12 and 13 illustrate embodiments of the latch mechanism 10 where the mirror image latches **26*a* and 26*b* each include a downwardly extending locking arm 42 from an outer marginal edge of the support tray 18 and carrying a locking shoulder 44 for fitting under a downwardly facing marginal edge locking surface 28 on the support tray 18. As depicted by the illustrated latch 26*b*, each locking arm 42 carries a cam surface 48 which is engaged by an upper edge of the support tray 18 as the support tray 14 is lowered thereon. This affects a outward defection of the locking arms 42 and an inward snapping back of the arms to lock the latches as the support plate seats on top of the support tray to the position shown in FIG. 12. Also shown in FIG. 12 in phantom outline is an optional finger operable extension 68 for use in affecting a release of the latch 26*b* by user simply pressing up on the extension to cause the associated locking arm 42 to deflect outwardly to affect the release of the locking shoulder 44 from the locking surface 28 when it is desired to separate the support plate 14 from the support tray 18 and dispense the support tray from the associated tip rack 12**.

In FIG. 13, the locking arm 42 carries an inward extension 70 for seating in a depression 72 in an edge of the support tray 18 to affect a locking of the support plate to the support tray. The automatic locking and manual release of the latch **26*b* illustrated in FIG. 13 is substantially the same as described with respect to FIG. 12**.

Figure 14:
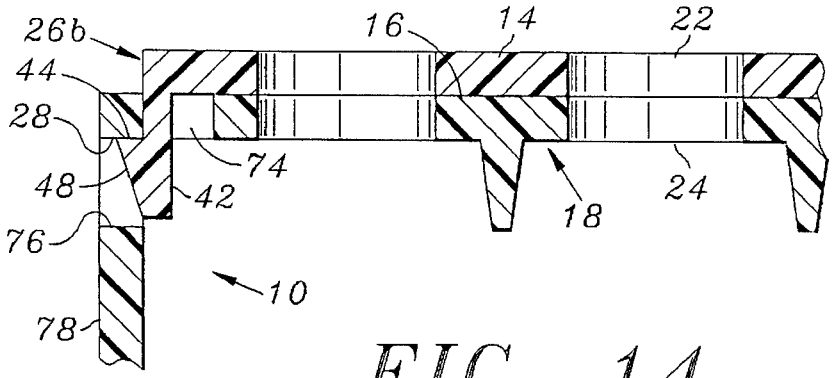
FIG. 14 is an enlarged fragmentary sectional side view of an alternative embodiment of the latch comprising a locking member extending downwardly from the support plate through a hole in the support tray to engage a downwardly facing locking surface on the support tray, the support tray having an opening in a side thereof exposing the locking member to a finger exerted force when it is desired to inwardly deflect the locking member and release the locking member from the locking surface and allow the support plate to be removed from the support tray.

In the embodiment illustrated in FIG. 14, the latch **26*b* of the latch mechanism 10 comprises a vertical locking arm 42 extending through a mating hole 74 in the top surface 16 of the support tray 18. The locking arm 42 carries the locking shoulder 44 which extends outwardly from the locking arm to engage a downwardly facing locking surface 28 defined by the top of a side hole 76 in a side 78 of the support tray 18. The locking arm 42 carries a cam surface 48 extending downwardly and inwardly from the locking shoulder 44 to affect an inward defection of the locking arm 42 as it passes through its associated mating hole to snap outwardly upon passing through the mating hole to affect the locking operation as illustrated in FIG. 13. When it is desired to release the latch 26*b* (and the mirror image latch 26*a*), the user simply presses inward on the cam surface 48 to affect a release of the locking shoulder 44 from the locking surface 28. By simultaneously affecting such a release of the mirror image latches 26*a* and 26*b*, the support plate 14 may be dispensed from the tip rack 12** by inverting the tip rack.

Thus, each embodiment of the latch mechanism of the present invention is characterized by an automatic locking action as the support plate carrying an array of pipette tips is lowered onto the support tray of an empty tip rack. Further, each latch mechanism holds the support plate flat on the support tray during the dispensing of pipette tips from the tip rack. Still further, each latch mechanism is characterized by a simple manual release to permit the empty support plate to be removed from the tip rack when it is desired to reload the tip rack with another array of pipette tips.

Accordingly, without occupying holes for receiving replacement pipette tips, and without requiring independent attachment operation by a technician, the present invention provides a simple and inexpensive hold down apparatus for releasably securing support plates for replacement pipette tips on support trays of reusable pipette tip racks without creating additional waste which must be disposed of after each reloading of a reusable tip rack.

While particularly preferred embodiments of the present invention have been described above, it is appreciated that changes and modifications may be made therein without departing from the spirit of the present invention. Accordingly, the present invention is to be limited only by the terms of the following claims.

We claim:

1. In a reusable tip rack for successively receiving and securing separate arrays of pipette tips each carried by a flat support plate adapted to rest on a top of a pipette tip support tray of the tip rack with an array of pipette tips extending through an array of holes in the top of the support tray, a manually releasable latch mechanism for releasably securing a support plate flat on the top of the support tray, comprising:

a laterally extending locking surface on one of the support plate or the support tray; and a manually releasable locking surface on one of the other of the support plate or the support tray for releaseably engaging the locking surface to releaseably secure the support plate flat on the top of the support tray.

2. The latch mechanism of claim 1 wherein the locking surface comprises a surface on the support plate and the locking member comprises an arm extending from the support tray with a locking shoulder extending from the arm to engage the locking surface to hold the support plate down on the top of the support tray.

3. The latch mechanism of claim 2 wherein the locking surface is a top surface on the support plate and the arm extends vertically from the support tray above the top surface and the locking shoulder extends inwardly toward the support plate to engage the top surface.

4. The latch mechanism of claim 3 wherein the arm and locking shoulder are located at a first side of the support tray and the locking shoulder engages a marginal edge portion of the top surface on the support plate to define a first latch and wherein the latch mechanism further includes a second latch comprising a second arm extending vertically from the support tray at a side opposite the first latch and carries a second locking shoulder for engaging an opposite marginal edge portion of the top surface of the support plate aid in releasably securing the support plate to flat on the top of the support tray.

5. The latch mechanism of claim 3 wherein the arm is resilient and flexible away from the support plate and carries a cam surface adjacent the locking shoulder for engaging an edge of the support plate to bend outwardly as the support plate is moved down onto the top of the support tray and to snap inwardly with the locking shoulder engaging the locking surface of the support plate as the support plate passes the cam surface.

6. The latch mechanism of claim 5 wherein the cam surface is exposed to receive a manual force for bending the arm away from the support plate to affect a release of the locking shoulder from the locking surface to release the support plate from the top of the support tray when it is desired to remove the support plate from the support tray.

7. The latch mechanism of claim 6 wherein the arm includes an extension beyond the cam surface for finger engagement by a user in bending the arm outwardly to produce a release of the locking surface and the support plate from the top of the support tray.

8. The latch mechanism of claim 2 wherein the locking shoulder comprises a downwardly facing surface on the arm for engaging an upwardly facing locking surface on the support plate.

9. The latch mechanism of claim 8 wherein the downwardly facing surface on the arm is on a projection from the arm and the upwardly facing locking surface is in a recess in a side of the support plate.

10. The latch mechanism of claim 8 wherein the downwardly facing surface is in a recess in the arm and the upwardly facing locking surface is at an edge of the support plate.

11. The latch mechanism of claim 1 wherein the locking surface comprises a surface on the support tray and the locking member comprises an arm extending from the support plate with a locking shoulder extending from the arm to engage the locking surface to hold the support plate on the support tray.

12. The latch mechanism of claim 11 wherein the locking surface is a downwardly facing surface on the support tray and the arm extends downwardly from the support plate and the locking shoulder extends toward the support tray to engage the downwardly facing surface.

13. The latch mechanism of claim 12 wherein the arm and locking shoulder are located at a first side of the support plate and the locking shoulder engages a marginal edge portion of the downwardly facing surface on the support tray to define a first latch and the latch mechanism further includes a second latch at a opposite edge of the support tray comprising a second arm extending from the support plate at a side opposite the first latch and carrying a second locking shoulder for engaging an opposite marginal edge portion of a downwardly facing locking surface on an opposite edge of the support tray to aid in releasably securing the support plate flat on the top of the support tray.

14. The latch mechanism of claim 12 wherein the arm extends downwardly through an opening in the top of the support tray and the locking shoulder is exposed by a hole in a side of the support tray enabling a user to push inwardly on the arm to release the locking shoulder from the locking surface and to allow a separation of the support plate from the top of the support tray.

15. The latch mechanism of claim 12 wherein the locking shoulder comprises a upwardly facing surface on a projection from the arm for engaging the downwardly facing locking surface at an edge of the support tray.

16. The latch mechanism of claim 12 wherein the arm extends through an opening in the top of the support tray and the locking shoulder comprises an upwardly facing surface engaging the downwardly facing locking surface on the support tray which further comprises a downwardly extending side for engaging the arm to affect a release of the locking shoulder from the locking surface with an inward pressure on the side of the support tray.

17. The latch mechanism of claim 3 wherein the vertical arm includes an extension below the top of the support tray at a marginal edge of the support tray for manual engagement by a user to rotate the arm and the locking shoulder outwardly with respect to the support plate to release the locking shoulder from the locking surface on the support plate.

* * * * *